US009192948B2

(12) United States Patent
Bodet et al.

(10) Patent No.: US 9,192,948 B2
(45) Date of Patent: Nov. 24, 2015

(54) DIFFUSER FOR A MULTI-WAY VALVE

(75) Inventors: Hervé Bodet, Verdun (FR); Eric Gaillard, Dieue sur Meuse (FR)

(73) Assignee: LINDAL FRANCE SAS, Briey (FR)

( * ) Notice: Subject to any disclaimer, the term of this patent is extended or adjusted under 35 U.S.C. 154(b) by 38 days.

(21) Appl. No.: 13/824,196

(22) PCT Filed: Sep. 16, 2011

(86) PCT No.: PCT/EP2011/066075

§ 371 (c)(1), (2), (4) Date: Mar. 15, 2013

(87) PCT Pub. No.: WO2012/045562

PCT Pub. Date: Apr. 12, 2012

(65) Prior Publication Data

US 2013/0284293 A1 Oct. 31, 2013

(30) Foreign Application Priority Data

Oct. 6, 2010 (FR) ..... 10 58115

(51) Int. Cl.

| | |
|---|---|
| ***B65D 35/22*** | (2006.01) |
| ***B05B 7/00*** | (2006.01) |
| ***B05B 1/16*** | (2006.01) |
| ***B65D 83/20*** | (2006.01) |
| ***B65D 83/68*** | (2006.01) |
| ***B65D 83/56*** | (2006.01) |
| *B05B 11/00* | (2006.01) |
| *B65D 83/62* | (2006.01) |
| *B05B 12/14* | (2006.01) |

(52) U.S. Cl.

CPC ..... *B05B 7/00* (2013.01); *B05B 1/1645* (2013.01); *B65D 83/20* (2013.01); *B65D 83/56* (2013.01);

(Continued)

(58) Field of Classification Search

CPC ..... B05B 1/1645; B05B 11/0029; B05B 12/1409; B05B 7/00; B65D 83/20; B65D 83/62; B65D 83/68; B65D 83/682; Y10T 137/86863

USPC ..... 222/135, 136, 144.5, 145.3, 402.17, 222/402.23, 485, 94, 96, 95, 402.1, 394, 222/143, 105; 137/625.46; 239/304, 305, 239/337, 413, 414, 549

See application file for complete search history.

(56) References Cited

U.S. PATENT DOCUMENTS 3,680,740 A * 8/1972 Kinnavy ..... 222/129
3,685,695 A * 8/1972 Yuhas ..... 222/129

(Continued)

FOREIGN PATENT DOCUMENTS

DE 7631034 U1 10/1978
EP 1281635 A1 2/2003
EP 2024256 A1 2/2009

OTHER PUBLICATIONS

International Search Report for PCT/EP2011/066075, mailing date of Oct. 25, 2011.

*Primary Examiner* — Frederick C Nicolas
*Assistant Examiner* — Bob Zadeh
(74) *Attorney, Agent, or Firm* — Westerman, Hattori, Daniels & Adrian, LLP

(57) ABSTRACT

A diffuser for a multiway valve, in particular for a two-way valve, includes a tip (2) to be secured to the portion of the valve stem that projects above the cup. To withdraw a single product, the tip includes a cylindrical portion having a circular cross-section with as many transfer channels (22*a*, 22*b*) are there are pathways in the multiway valve, for sealingly connecting each transfer channel to the outlet of the corresponding pathway of the valve, each transfer channel opening outside the cylindrical portion of the tip in a different radial plane and in a different angular sector of the cylindrical portion. The diffuser is also provided with a pivotable cap (3) with a blind hole (31) having a shape complementary to the cylindrical portion of the tip, the pivotable cap having as many outlet channels (32*a*, 32*b*) as there are pathways in the multiway valve.

20 Claims, 13 Drawing Sheets

Figure 1:
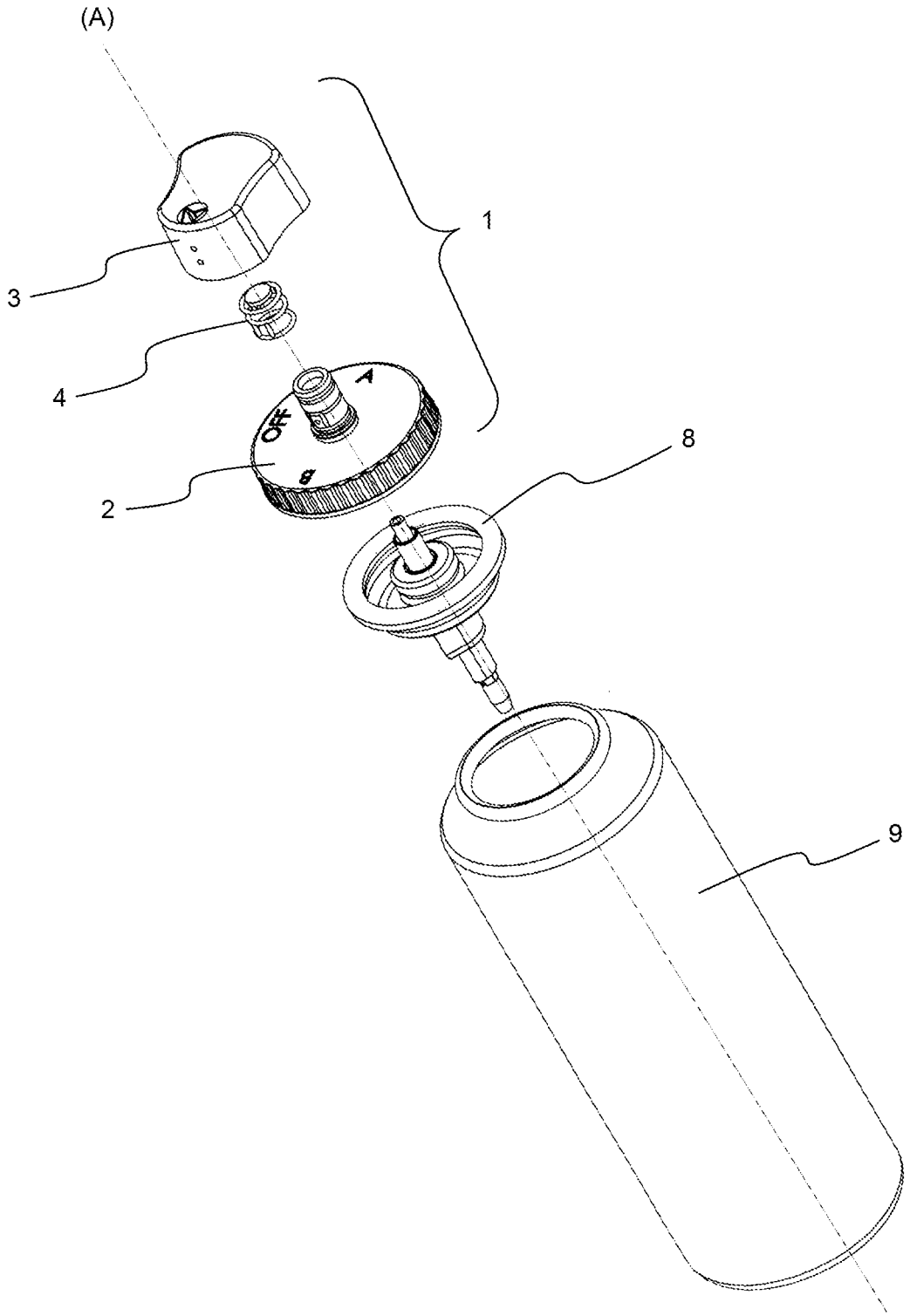

(52) U.S. Cl.
CPC ..... *B65D 83/68* (2013.01); *B65D 83/682* (2013.01); *B05B 11/0029* (2013.01); *B05B 12/1409* (2013.01); *B65D 83/62* (2013.01); *Y10T 137/86863* (2015.04)

(56) References Cited

U.S. PATENT DOCUMENTS

| | | | | |
|---|---|---|---|---|
| 3,693,837 | A | 9/1972 | Yuhas | |
| 3,915,345 | A | 10/1975 | Harrison et al. | |
| 3,982,668 | A * | 9/1976 | Riccio | 222/95 |
| 4,595,127 | A | 6/1986 | Stoody | |
| 5,593,065 | A * | 1/1997 | Harrold | 222/94 |
| 5,735,465 | A * | 4/1998 | Laforcade | 239/337 |
| 6,419,168 | B1 * | 7/2002 | Thieleke et al. | 239/337 |
| 7,195,135 | B1 * | 3/2007 | Garcia et al. | 222/137 |
| 7,748,568 | B2 * | 7/2010 | Lasserre et al. | 222/135 |
| 7,798,366 | B2 * | 9/2010 | Hoshino | 222/136 |
| 7,854,350 | B2 * | 12/2010 | Lasserre et al. | 222/137 |
| 8,317,062 | B2 * | 11/2012 | Bodet et al. | 222/95 |
| 2003/0024953 | A1 | 2/2003 | Lilienthal | |
| 2009/0230344 | A1 | 9/2009 | Bodet et al. | |

* cited by examiner

DIFFUSER FOR A MULTI-WAY VALVE

The invention relates to a diffuser for a multiway valve having n channels provided with a projecting stem, n being equal to or greater than 2, which diffuser comprises a tip intended to be secured to the projecting part of the stem. The invention relates in particular to a diffuser for two-way valve.

Multiway valves are known, in particular from EP 1 281 635 A1 and EP 2 024 256 A1. These are valves which make it possible to withdraw as many products as there are pathways without these products meeting before they leave the valve. They are intended for products which must be separated during storage and must come into contact with one another only at the time of their application so as to prevent them from reacting together prematurely.

Diffusers intended for these multiway valves make it possible to actuate the valve. They are equipped with outlet channels that usually do not meet. This prevents the products from coming into contact with one another until after they have left the diffuser. Thus, a single pressure action makes it possible to withdraw all products contained in the housing simultaneously.

However, it can be useful to withdraw only one of the products. But these diffusers of the state of the art do not allow it.

The objective of the invention is therefore to develop diffusers that make it possible to withdraw only one or another of the various products contained in the housing. Another objective is to make it possible to additionally withdraw all of the products simultaneously.

This first objective is achieved in that the tip comprises a cylindrical portion having a circular cross-section in which n transfer channels are provided (and therefore as many transfer channels as there are pathways in the multiway valve), each channel being equipped with means for sealingly connecting it to the outlet of the corresponding pathway of the valve when it is mounted on said valve, each transfer channel opening outside the cylindrical portion of the tip in a different radial plane and in a different angular sector of the cylindrical portion. In addition, the diffuser is further provided with a pivotable cap provided with a blind hole having a shape complementary to the cylindrical portion of the tip, which cap is rotatably secured by suitable means to the cylindrical portion of the tip. The pivotable cap is provided with n outlet channels (that is, as many channels as there are pathways in the multiway valve), these outlet channels being arranged one above the other in a same axial plane and in the same radial planes as the corresponding transfer channels. Thus, to each outlet pathway of the valve corresponds a transfer channel in the tip and an outlet channel in the cap. When the cap is secured on the tip, the transfer channel and the outlet channel of a pathway are located in a same horizontal plane. Thus, when the cap is rotated around the cylindrical tip, one of the outlet channels of the cap can be aligned with the corresponding transfer channel of the tip. The other outlet channels, located above or below the aligned outlet channel, will not be aligned with the corresponding transfer channels since the latter are all placed in different angular sectors. The aligned transfer channel being sealingly connected to the outlet of one of the pathways of the multiway valve, it is possible to withdraw the corresponding product from the housing. The other products will not be allowed to come out since their transfer channel and outlet channel are not aligned.

In order to allow, not only withdrawal of a single one of the products contained in the housing, but also simultaneous withdrawal of all the products, it is possible to provide the tip with a second set of transfer channels comprising as many transfer channels as there are pathways in the multiway valve, these transfer channels being arranged one above the other in a common axial plane, in an angular sector different from the transfer channels of the first set, wherein to each of the transfer channels of the first set corresponds a transfer channel of the second set located in the same radial plane and communicating with it. Consequently, to each outlet pathway of the valve corresponds, firstly, a first transfer channel and a second transfer channel in the tip, and an outlet channel in the cap. These three channels are in a same radial plane. Whereas the transfer channels of the first set which make it possible to withdraw a single product are not disposed one above the other but in different angular sectors, those of the second set are aligned vertically like the outlet channels. Thus, when an outlet channel is aligned with the corresponding transfer channel of the second set of transfer channels, then all the other transfer channels of this second set are aligned with the other outlet channels. Actuating the valve makes it possible to withdraw all the products simultaneously. As with the first set of transfer channels, it is preferable to provide seals around the outlet openings of each transfer channel of the second set.

To prevent any of the products from entering the gap between the outer face of the cylindrical portion of the tip and the inner face of the blind hole of the cap, it is preferable to provide seals around each outlet opening of the various transfer channels to ensure sealing between the outer side of the cylindrical portion of the tip and the inside of the blind hole of the pivotable cap.

It can be easier to provide all the seals together in a same seal unit having as many windows as there are transfer channels, said windows being arranged so that each of them surrounds the outlet opening of a transfer channel. To this effect, the seal unit can be constituted by as many sealing rings plus one as there are channels in the multiway valve, that the sealing rings are arranged one above the other and in that two successive sealing rings are joined together by two straight elements so as to form a window. In another embodiment, the seal unit is formed by a sleeve in which as many openings are provided as there are pathways in the multiway valve, each opening forming a window.

To facilitate the handling of the pivotable cap, it is preferable to provide it with a prehension ring surrounding the central portion provided with the blind hole.

The connecting means of the transfer channels can each be constituted by a hole having dimensions complementary to those of the outlet of the corresponding pathway of the multiway valve, so as to be able to be sealingly fitted onto said outlet and by a transfer chamber into which the corresponding pathway of the valve opens when the diffuser is in the position mounted on the valve and from which the corresponding transfer channel of the first set, and, if appropriate, the corresponding transfer channel of the second set, start.

The invention also relates to a multiway valve provided with a diffuser according to the invention and a pressurized container provided with such a valve.

In a preferred embodiment of the invention, the various pathways of the valve have concentric outlets and/or concentric inlets.

The diffuser according to the invention is particularly well suited for two-way valves. In this case, the tip comprises a cylindrical portion having a circular cross-section in which two transfer channels are formed, each transfer channel opening outside the cylindrical portion of the tip in a different radial plane and in a same axial plane but at 180° relative to each other. Likewise, the pivotable cap is provided with two outlet channels arranged one above the other in a same axial plane and in the same radial planes as the corresponding transfer channels. The tip of this two-way diffuser can also include a second set of transfer channels comprising two transfer channels, these transfer channels being arranged one above the other in a same axial plane, in an axial plane perpendicular to the axial plane containing the transfer channels of the first set, wherein to each transfer channel of the first set corresponds a transfer channel of the second set located in the same radial plane and communicating with it.

The invention will be described in more detail below with reference to two embodiments of the invention.

Figure 2:
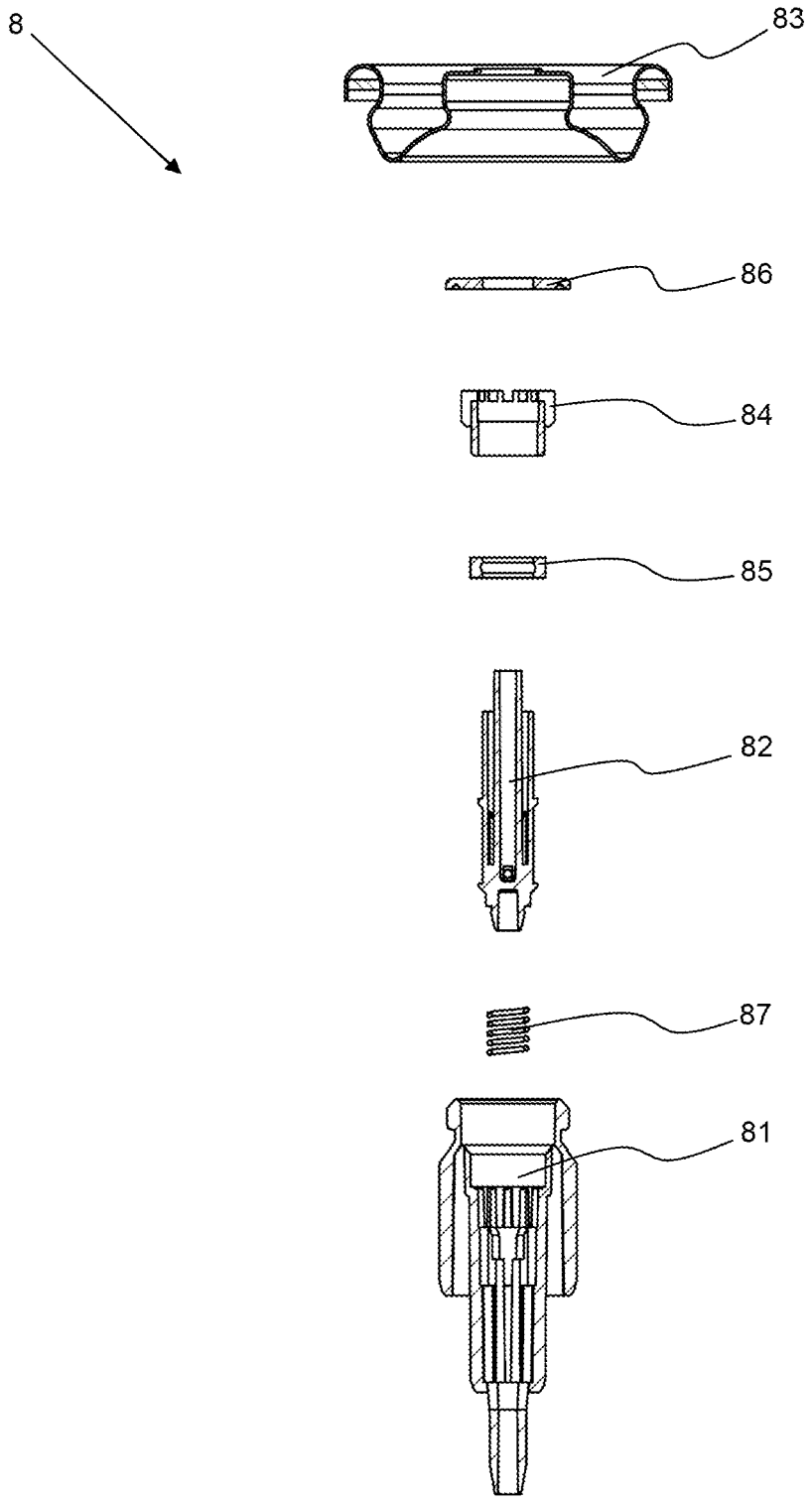
Figure 3:
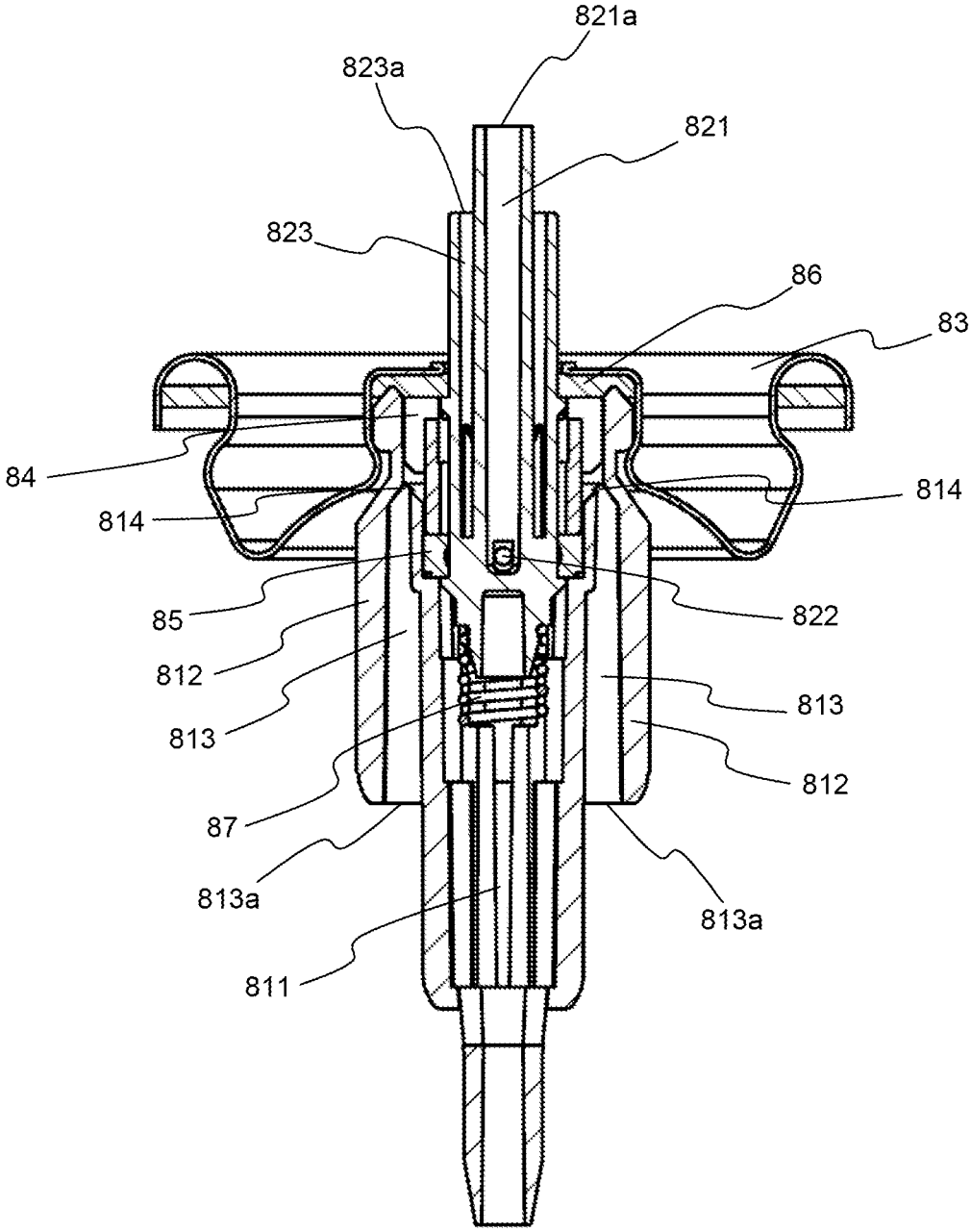
Figure 4:
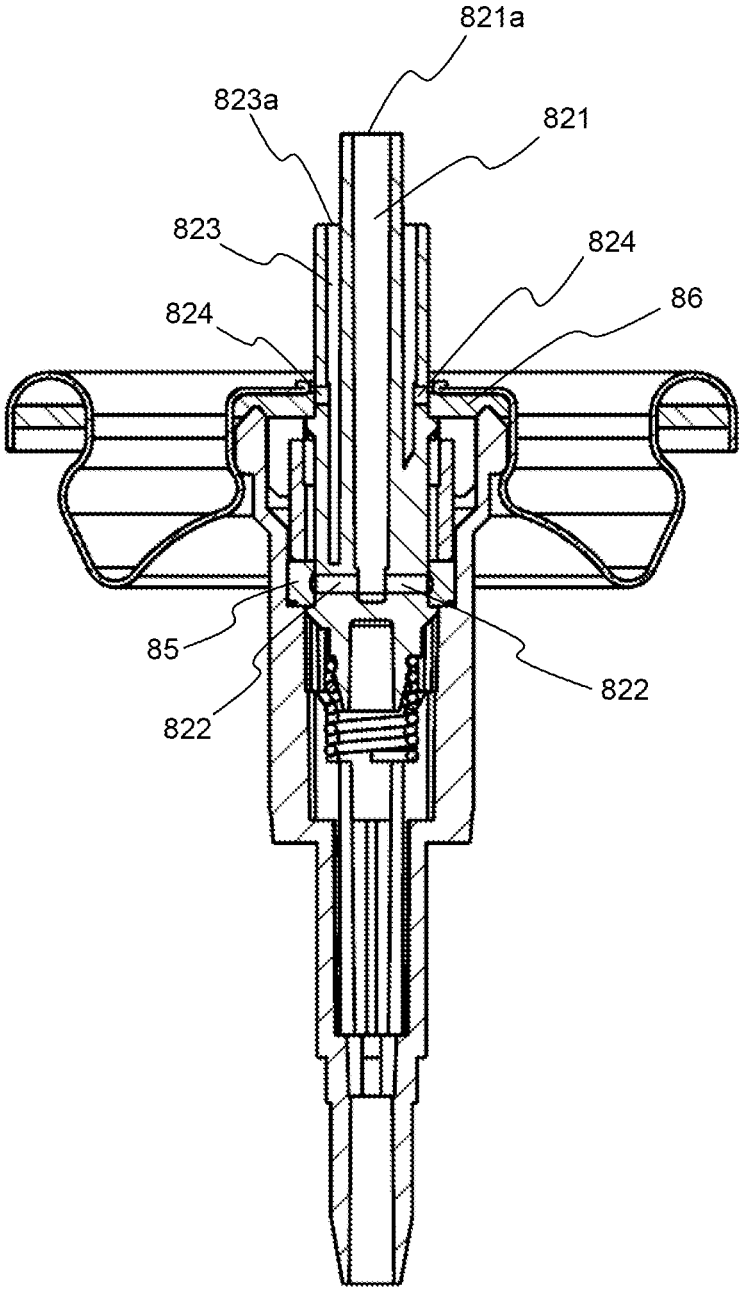
Figure 5A:
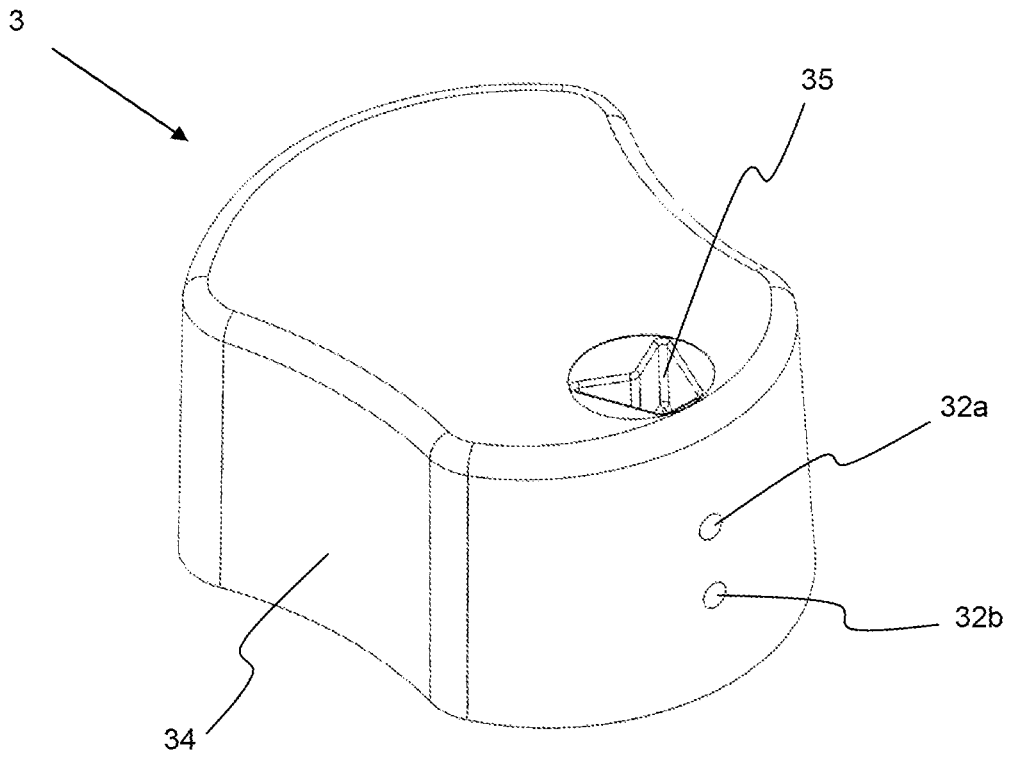
Figure 5B:
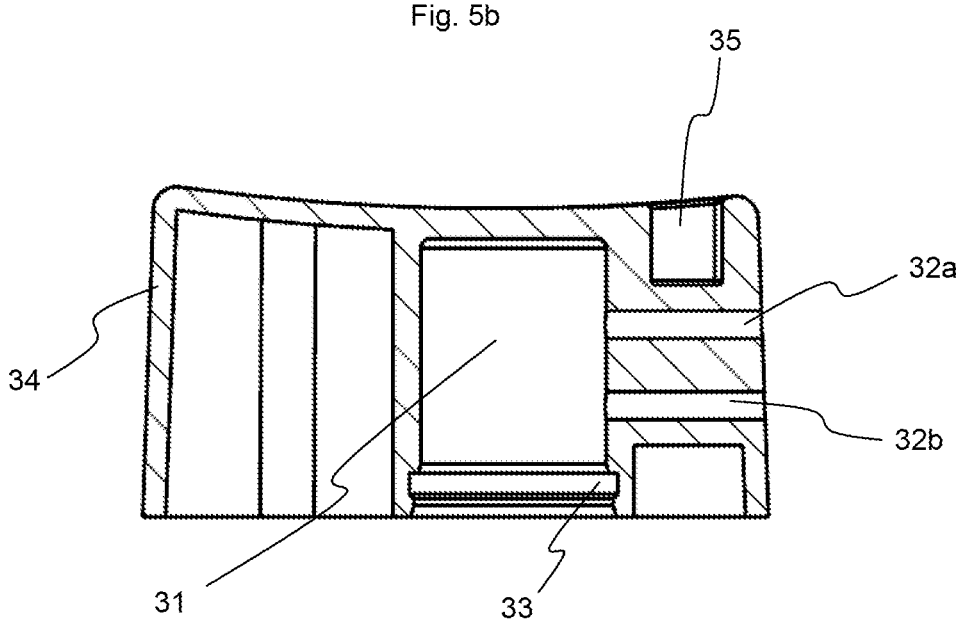
Figure 6A:
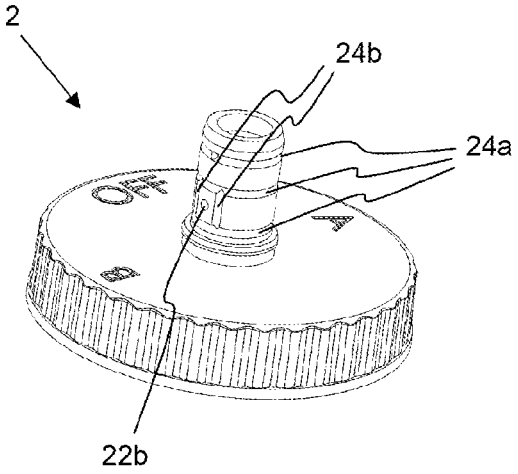
Figure 6B:
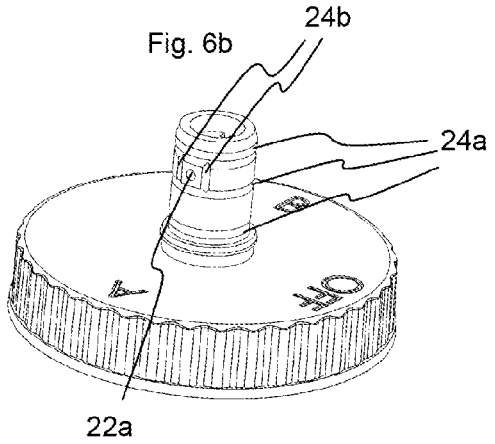
Figure 6C:
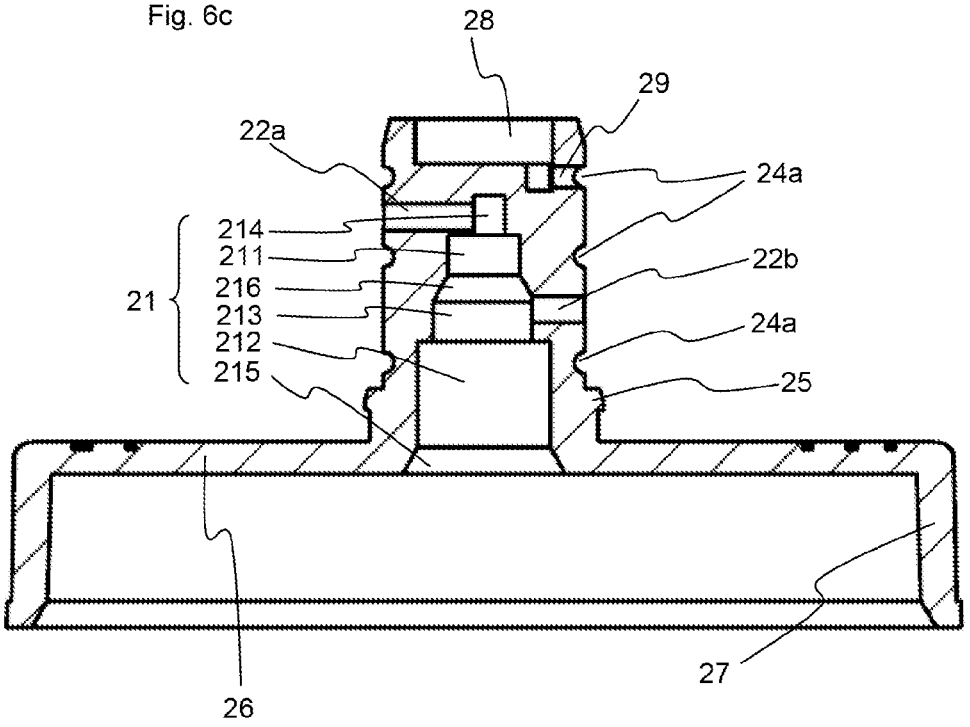
Figure 7:
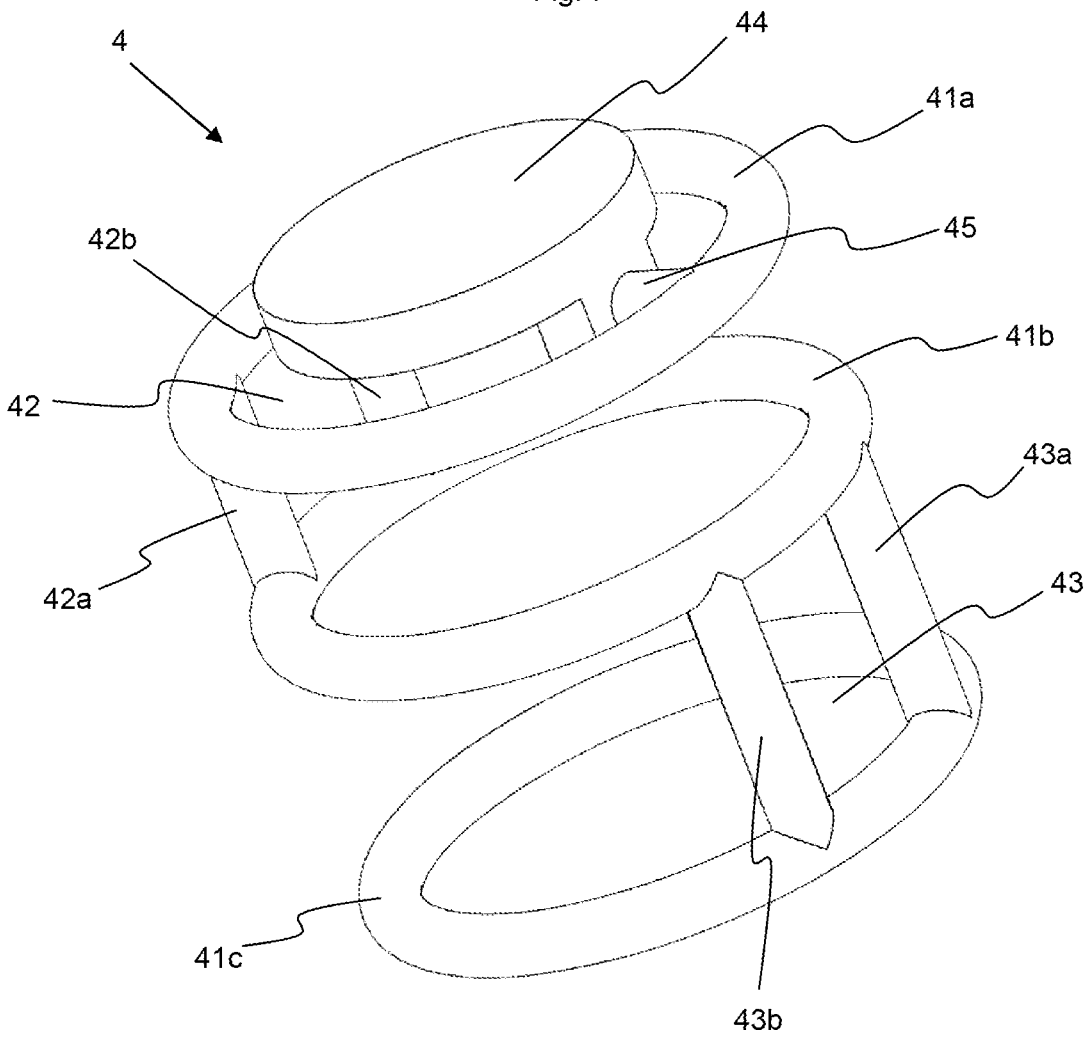
Figure 8A:
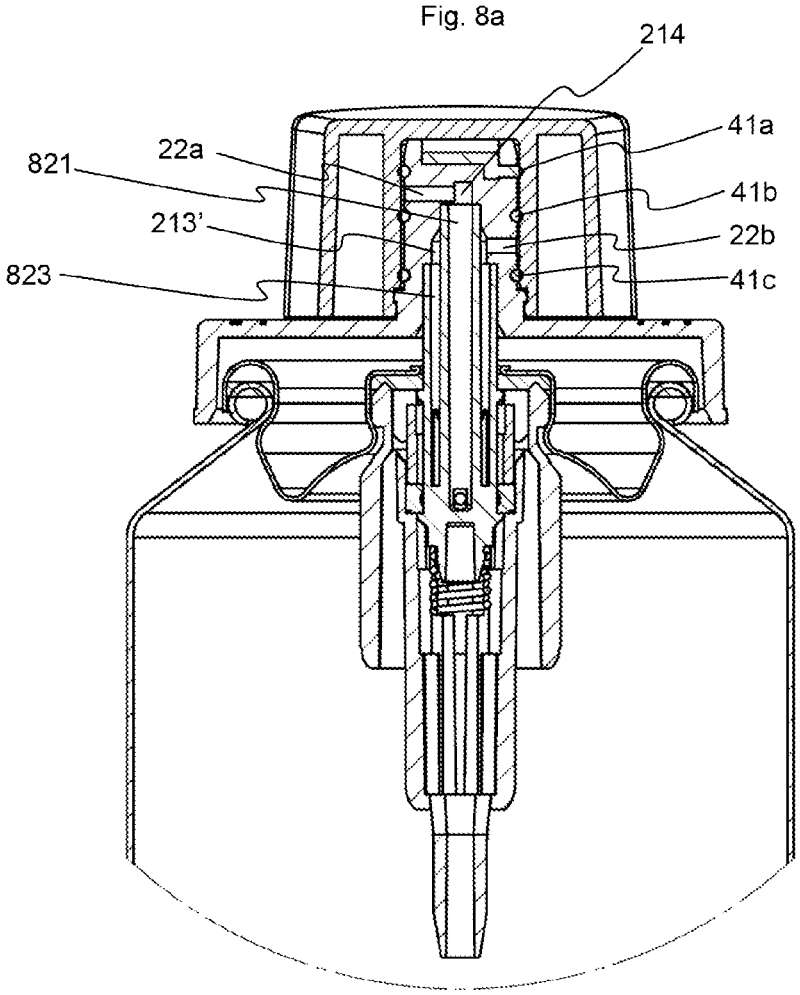
Figure 8B:
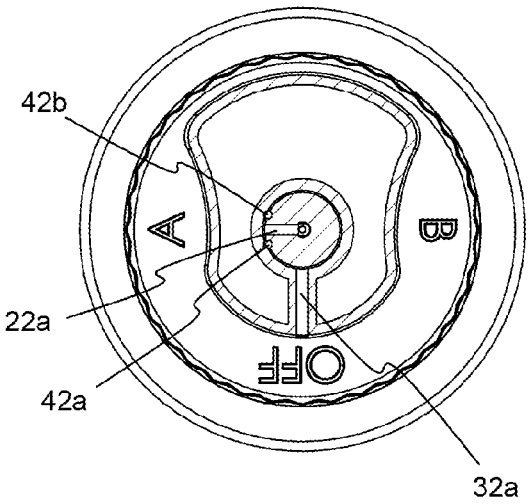
Figure 8C:
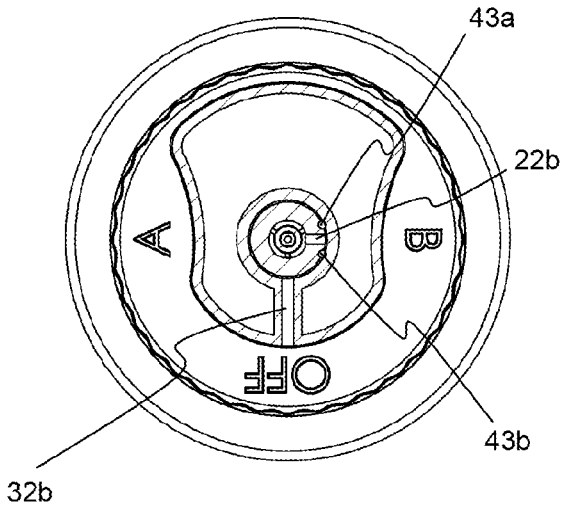
Figure 9A:
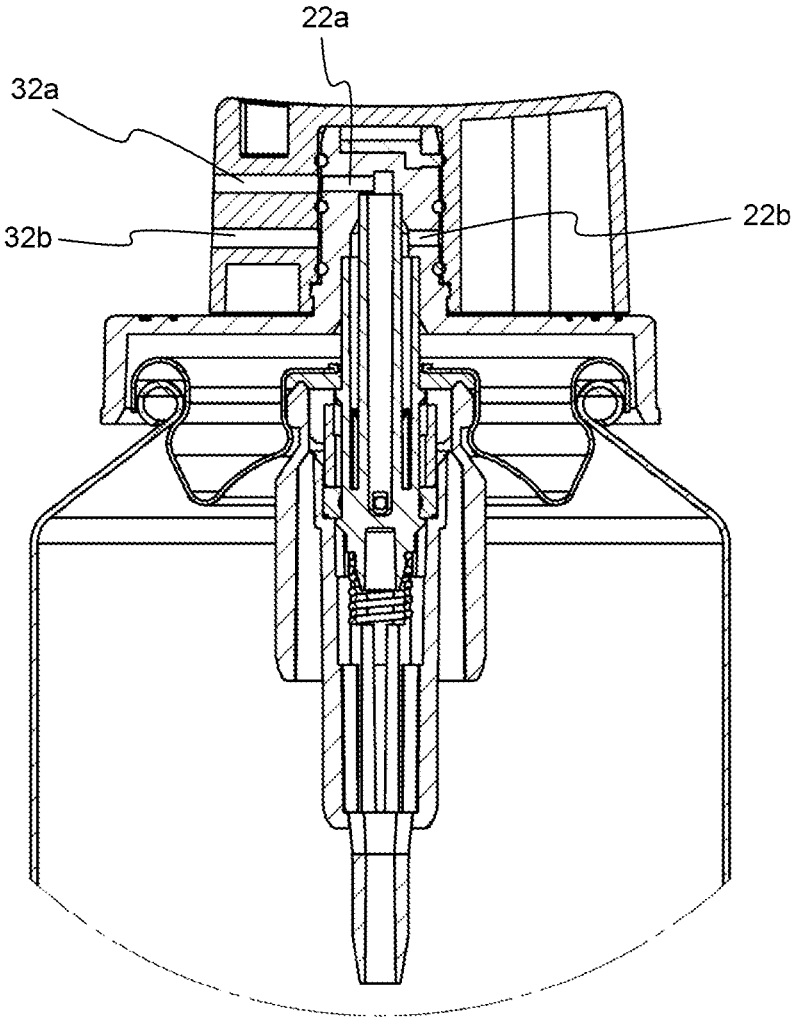
Figure 9B:
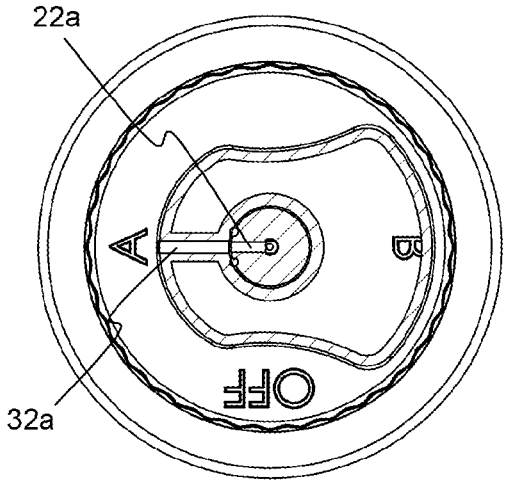
Figure 9C:
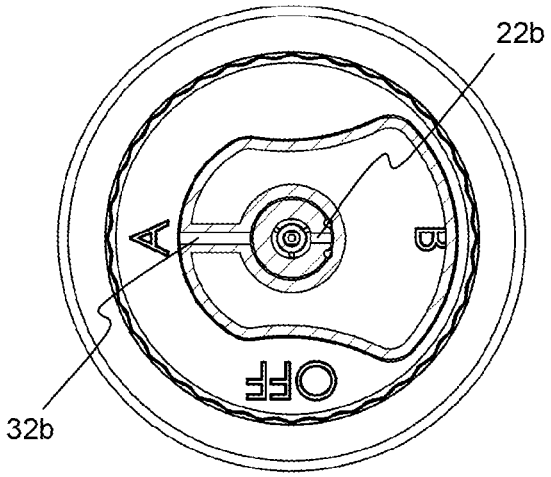
Figure 10A:
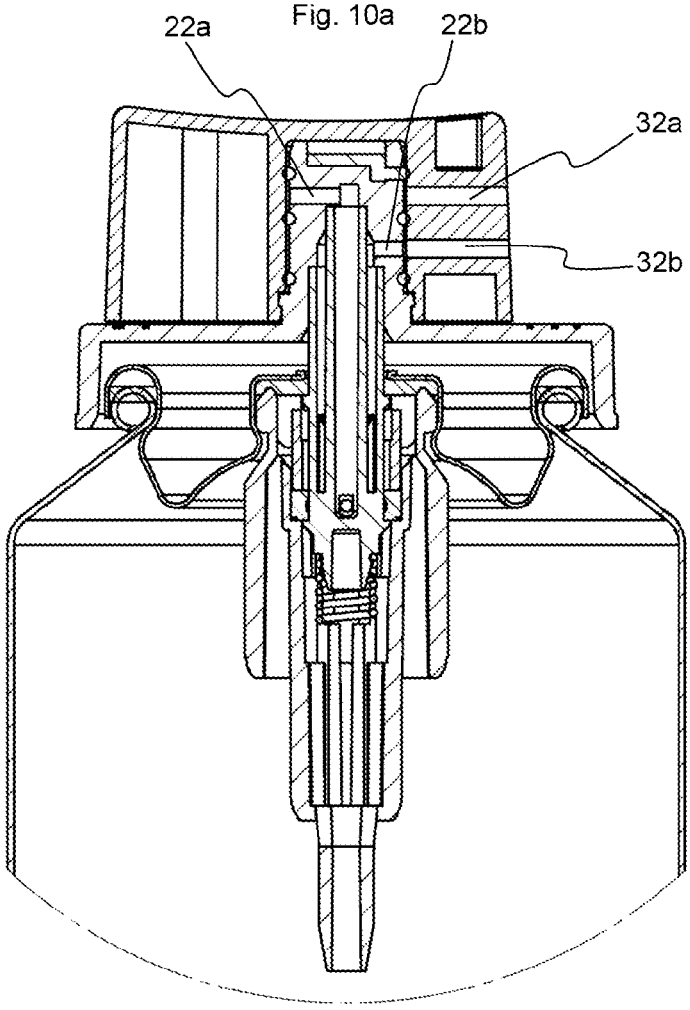
Figure 10B:
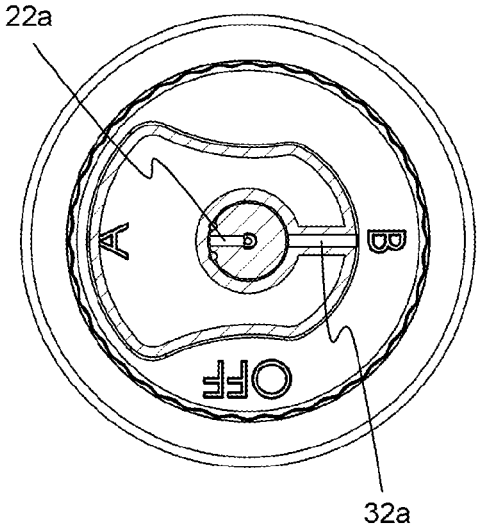
Figure 10C:
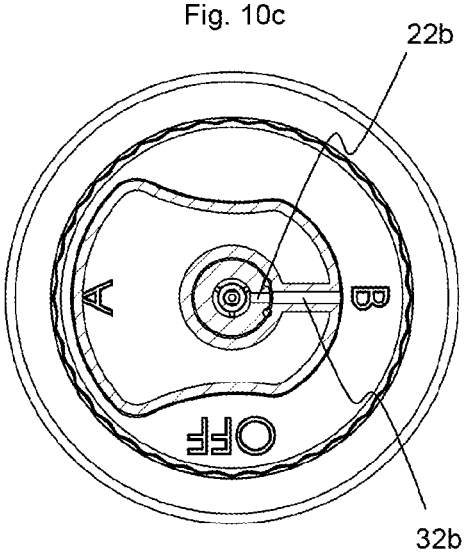
Figure 11A:
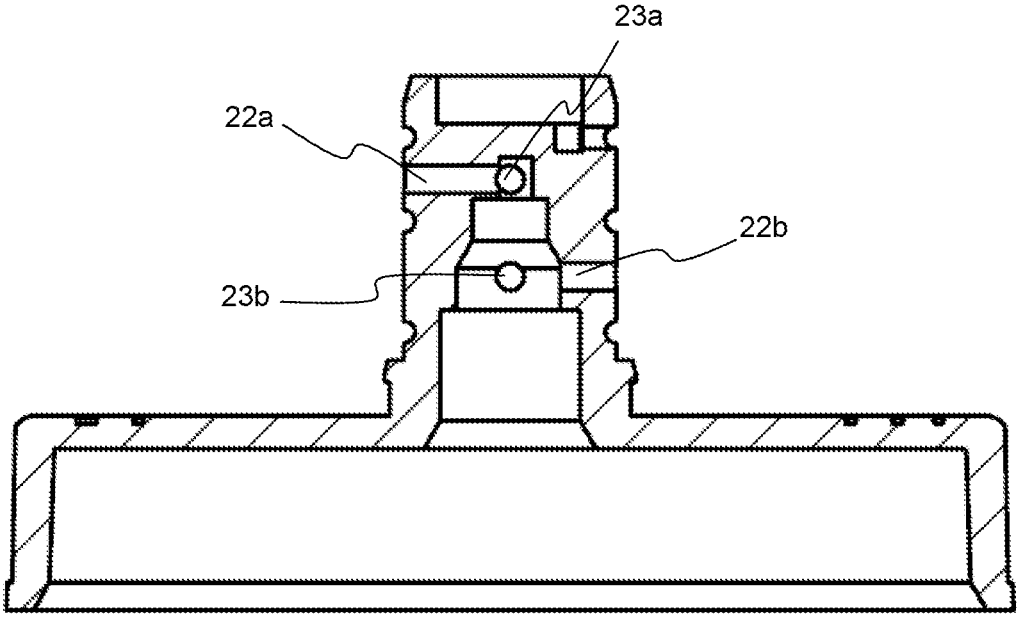
Figure 11B:
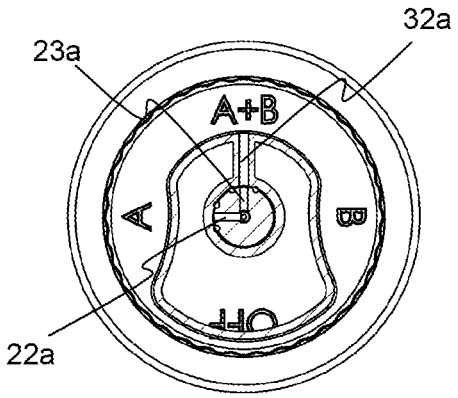
Figure 11C:
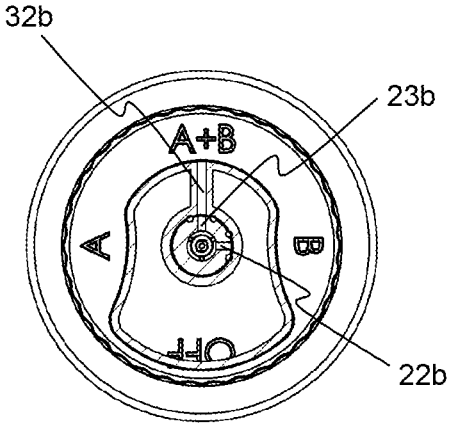
Figure 12:
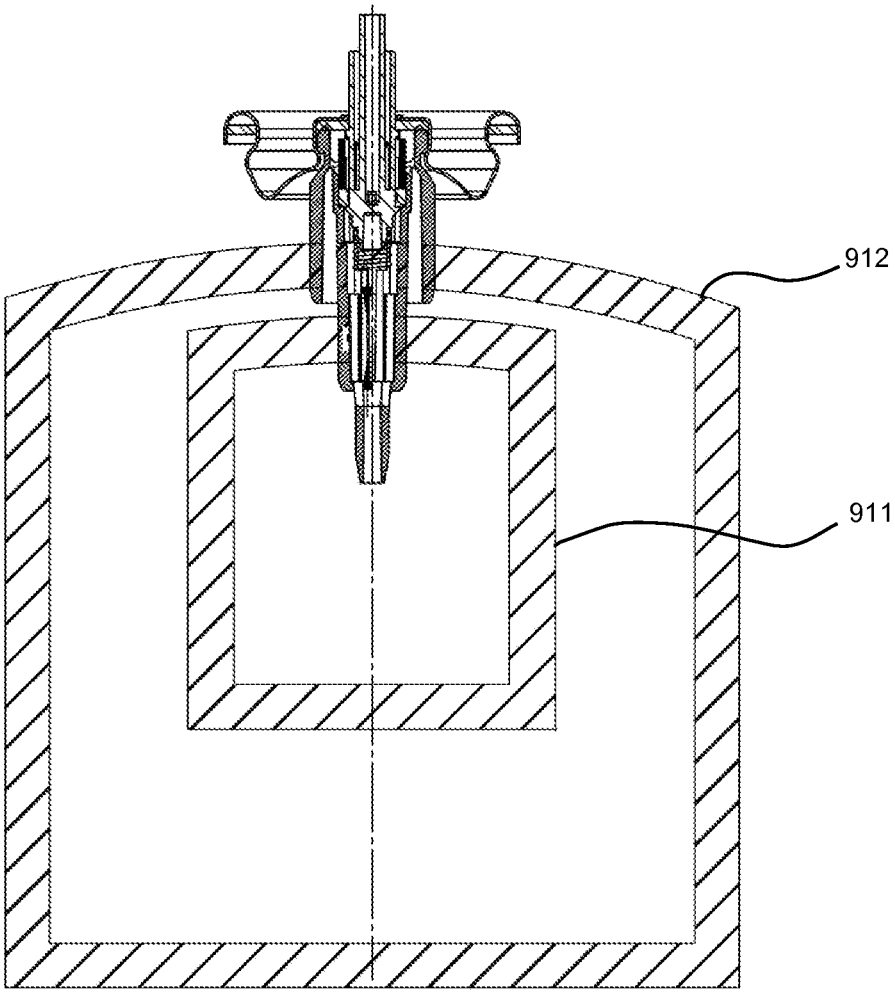
Figure 13:
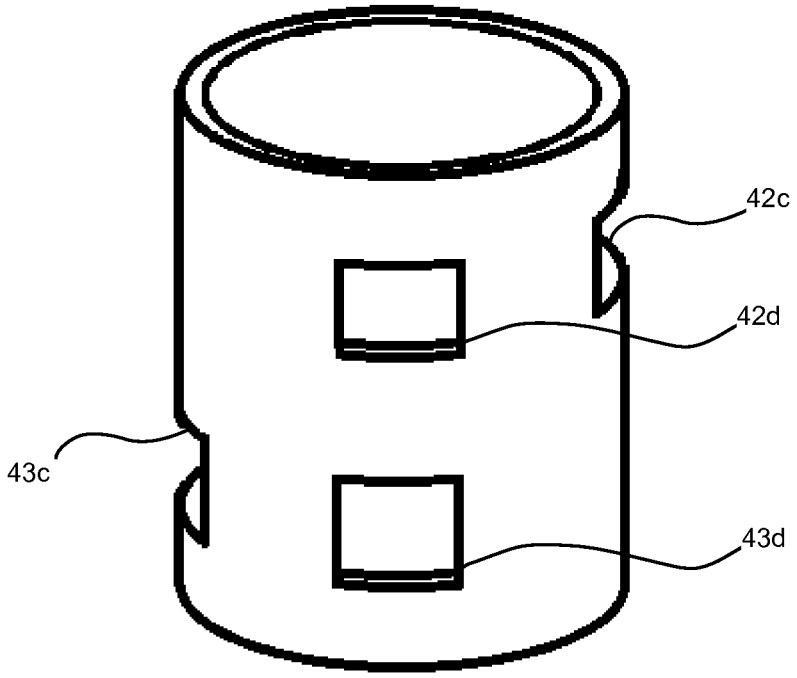

FIG. 1: exploded view of a pressurized container equipped with a diffuser according to the invention;

FIG. 2: exploded view of a two-way valve in cross-section along a first longitudinal (vertical) plane;

FIG. 3: cross-sectional view of the two-way valve of FIG. 2 along the plane of FIG. 2;

FIG. 4: cross-sectional view of the two-way valve of FIG. 2 along a second longitudinal (vertical) plane perpendicular to the plane of FIG. 2;

FIG. 5: (*a*) perspective view and (*b*) cross-sectional view of the pivotable button of the diffuser of the invention;

FIG. 6: (*a*) and (*b*) perspective views of the front and back, and (*c*) cross-sectional view, of the tip of the diffuser of the invention;

FIG. 7: perspective view of the seal of the diffuser of the invention;

FIG. 8: (*a*) cross-sectional view along the first longitudinal plane, (*b*) cross-sectional view along a first radial (horizontal) plane passing through the first transfer channel, and (*c*) cross-sectional view along a second radial plane passing through the second transfer channel of the container of FIG. 1, the diffuser being in the closed position;

FIG. 9: (*a*) cross-sectional view along the first longitudinal plane, (*b*) cross-sectional view along a first radial (horizontal) plane passing through the first transfer channel and (*c*) cross-sectional view along a second radial plane passing through the second transfer channel of the container of FIG. 1, the diffuser being in a first open position;

FIG. 10: (*a*) cross-sectional view along the first longitudinal plane, (*b*) cross-sectional view along a first radial (horizontal) plane passing through the first transfer channel and (*c*) cross-sectional view along a second radial plane passing through the second transfer channel of the container of FIG. 1, the diffuser being in a second open position;

FIG. 11: (a) cross-sectional view along a first radial (horizontal) plane passing through the first transfer channels, (b) cross-sectional view along a second radial plane passing through the second transfer channels of the container of FIG. 1 provided with a tip according to a second embodiment, the diffuser being in a third open position, and (c) view of the tip according to the second variant;

FIG. 12: cross-sectional view of the two-way valve of FIG. 3 in a variant with a first flexible pouch and second bag;

FIG. 13: cross-sectional view of a variant of a joint in the shape of a sleeve with additional superposed windows for outlet openings of transfer channels.

It is to be noted that the position indications such as "below" or "above", "lower portion" or "upper portion" refer to the position the diffuser would have once mounted on a pressurized container positioned with the valve facing up, as shown in FIGS. 8, 9, and 10. Of course, this does not describe absolute spatial references and the diffuser can be used in all positions, including with the valve facing down. The container and its constituent parts, in particular the housing, have a certain symmetry around an imaginary axis (A) passing through the center of the housing and of the valve (see FIG. 1). Thus, a first longitudinal plane is defined (see FIG. 3, 8*a*, 9*a*, 10*a*) which passes through this axis, this plane being vertical when referring to FIGS. 8*a*, 9*a* and 10*a*. A second longitudinal plane is defined (see FIG. 4) which passes through this axis and is perpendicular to the first. Finally, radial planes are defined which are perpendicular to this axis (see FIGS. 8*b/c*, 9*b/c*, 10*b/c* and 11*b/c*). Thus, they are horizontal when we refer to FIGS. 8*a*, 9*a* and 10*a*. The terms "axial" and "radial" always refer to this general axis.

The diffuser of the invention (1) is intended for a pressurized container equipped with a multiway valve (8). A multiway valve is a valve which comprises two or more internal pathways which allow a same number of different products contained in separate spaces located within a housing (9) to be extracted from the container without coming into contact with one another before they leave the valve. Thus, the outlet pathways of these multiway valves must not meet inside the valve. In the example presented here, the valve is a two-way valve, such as described, for example, in patent applications EP 1 281 635 A1 and EP 2 024 256 A1.

This two-way valve is essentially constituted by a valve body (81) inside which are placed, from bottom to top, a spring (87), a stem (82) around which are placed a first internal seal (85), a ring (84), a second inner seal (86) and a cup (83). The valve body (81) is essentially constituted by a tubular wall which is crossed right through by a channel (811). It is equipped with two symmetrical lateral fins (812) which form two lateral channels (813) open toward the bottom (813*a*) and opening into the channel (811) via orifices (814) formed at the top of the lateral channels and opening in the area of the ring (84), between the two seals (85, 86).

As shown in FIG. 12, a first flexible pouch (911) is secured to the lower portion of the valve body (81), underneath the fins (812). If required, a second bag (912) can be attached to the valve body in the area of the fins, the first pouch being then contained in the second. The first product is contained in the first pouch, the second being contained either in the housing (9) with the propellant gas or in the second pouch, separate from the propellant gas. In the latter case, through holes (not shown) can be provided in the valve body, above the fins (812), to let the gas out at the same time as the second product.

The stem (82) is movable between a high position in which the valve is closed (position shown in the Figures) and a low position in which the valve is open. This stem (82) has two coaxial channels (821, 823) open at the top (821*a*, 823*a*) toward the outside of the valve. These two channels do not communicate. Each channel has, in its lower portion, two orifices (822, 824) that contact the inside of the channel with the outer side face of the stem (82). The orifices (822) of the central channel (821) open below the orifices (824) of the annular channel (823). Two seals (85, 86) are provided inside the valve body (81). When the valve is closed, the orifices (822) of the central channel are blocked by the lower seal (85), whereas those (824) of the annular channel (823) are blocked by the upper seal (86) as shown in FIG. 4. When the stem (82) is moved downwards against the action of the spring (87), the orifices (822, 824) pass below their respective seals and the valve is opened.

The lower seal (85) serves, on the one hand, to block the passage orifices (822) of the central channel (821), and on the other hand, to separate the channel (811) of the valve body into two spaces, the first, below, intended for passage of the product contained in the first pouch and the second, above, intended for passage of the product contained in the housing or in the second pouch.

It will be noted that the central channel (821) of the stem extends beyond the outlet opening (823*a*) of the annular channel (823). Similarly, the annular channel (823) protrudes above the cup (83).

Thus formed, the two-way valve makes it possible to withdraw simultaneously two products stored separately in a pressurized housing when downward pressure is exerted on the stem (82). To each product corresponds a distinct outlet pathway so that the two products do not come into contact until they are outside the valve. The first product contained in the first pouch passes through the bottom of the channel (811) of the valve body, enters into the central channel (821) of the stem through the first orifices (822) and leaves through the first outlet opening (821*a*). The second product contained, either in a second bag surrounding the first, or directly in the housing, enters into the second channels (813) of the valve body, passes through the orifices (814), passes through the ribs of the ring (84) and enters into the annular channel (823) of the stem through the second orifices (824), and leaves the valve through the second outlet opening (823*a*).

To allow withdrawal of only one of the two products, the diffuser of the invention has been provided. It is constituted essentially by two portions: a tip (2) and a pivotable button (3).

The tip (2) is constituted by a cylindrical portion within which a blind hole (21) is formed. This hole is divided into several successive portions. A first portion (211) is located in the bottom of the blind hole (21), that is, above. Its diameter corresponds to the outer diameter of the wall of the stem forming the central channel (821). A second portion (212) is located in the area of the opening of the blind hole, that is, below. Its diameter corresponds to the outer diameter of the wall forming the annular channel (823) of the stem. Between the two is arranged an intermediate portion (213) whose diameter is comprised between the two. The junction between the second portion (212) and the intermediate portion (213) is through a radial wall. The upper part of the intermediate portion (213) may be flared (216) to facilitate the introduction of the projecting end of the stem. Thus, the junction between the intermediate portion (213) and the first portion (211) has a frustoconical shape. Similarly, it is possible to flare the inlet of the second portion (212) while also giving it a frustoconical shape (215).

The heights of the various portions are selected so that, when the tip (2) is placed on the portion of the stem projecting above the cup, the ends of the walls that define the channels (821, 823) penetrate each in the corresponding portion (211, 213) of the blind hole of the tip while forming in each case a sealed connection. The top end of the wall forming the first channel (821) of the stem and/or the top end of the wall forming the second channel (823) of the stem come to be supported against the bottom radial wall or against the wall at the junction between the second portion and the intermediate portion, respectively.

A first, cylindrical transfer chamber (214) is formed above the first portion (211). Its diameter is less than the outer diameter of the wall forming the first channel (821) of the stem in order to perform a stop function for the top end of this wall. A first transfer channel (22*a*) is formed radially in the tip in the area of the first transfer chamber (214).

When the tip is mounted on a valve, a second, annular transfer chamber (213') is formed in the space defined between the intermediate portion (213) and the portion of the wall forming the first channel (821) of the stem which protrudes above the second opening (823*a*). A second transfer channel (22*b*) is formed radially in the tip in the area of the intermediate portion (213), and thus of the second transfer chamber (213'). This second transfer channel (22*b*) is arranged in the same axial plane as the first (22*a*), but on the opposite portion of the cylindrical wall. Thus, the outlet openings of the transfer channels (22*a*, 22*b*) are located opposite one another. In addition, the two channels are in different radial planes.

The two transfer channels (22*a*, 22*b*) form a first set of channels. If the diffuser must permit, not only the removal of one or the other of the products, but also the removal of the two products simultaneously, it is possible to provide a second set of transfer channels (23*a*, 23*b*), as is shown in FIG. 11. In this second set, the two channels are not only in a same axial plane, perpendicular to the axial plane of the first set (22*a*, 22*b*), but their outlet openings are directed toward the same side and are thus situated one above the other, at 90° relative to the outlet openings of the first set. The first channel (23*a*) of the second set is located in the same radial plane (at the same height) as the first channel (22*a*) of the first set, while the second channel (23*b*) of the second set is in the same radial plane (at the same height) as the second channel (22*b*) of the first set. The two first transfer channels (22*a*, 23*a*) of the first and second set communicate through the first transfer chamber (214) from which they both start. Likewise, the two second transfer channels (22*b*, 23*b*) of the first and second set communicate through the second transfer chamber (213') from which they both start.

A shoulder (25) is provided on the outer face of the cylindrical portion of the tip, below the second transfer channel or channels (22*b*, 23*b*). This shoulder serves to snap the pivotable button (3).

In order to allow identification of the various transfer channels (22*a*, 22*b*, 23*a*, 23*b*), it is preferable to extend the cylindrical portion of the tip in its lower part, that is, in the area of the opening of the blind hole, by a radial wall (26) at the surface of which markings can be affixed in alignment with the channels. In the example shown, an "A" has been affixed below the outlet opening of the first channel (22*a*) of the first set, a "B" has been affixed below the outlet opening of the second channel (22*b*) of the first set, and an "OFF" has been affixed at 90° relative to the first two markings, facing the solid wall of the cylindrical portion. If a second set of channels (23*a*, 23*b*) is provided, an "A+B" may be affixed, for example, below the openings of these channels, opposite the "OFF" marking.

The radial wall (26) may be extended downwardly by an axial ring (27), which may be provided with splines on its outer face.

The tip equipped with the two sets of transfer channels of FIG. 11 is divided, as viewed from above, in four angular sectors of 90° each. In the first angular sector located at the bottom of FIGS. 11*b/c*, the wall of the tip is solid. This is the location facing the "OFF" marking. In the next angular sector (to the left), shifted by 90° relative to the first, the first transfer channel (22*a*) of the first set is located in the upper radial plane and the "A" marking is located on the radial wall (26). In the third angular sector (above), located at 180° relative to the first and at 90° relative to the second, the two transfer channels (23*a*, 23*b*) of the second set are located, arranged one above the other, but in two different radial planes. On the radial wall (26), "A+B" can be read. Finally in the fourth quadrangle, the second transfer channel (22*b*) of the first set is located, in a radial plane different from the first and at 180° relative to it. This second transfer channel (22*b*) is located at 90° relative to the channels of the second set and at 270° relative to the closed position of the first angular sector.

Of course, it is not imperative that all angular sectors are the same size. It is understood that when there are more than two pathways, there will be more angular sectors, the important thing being that no transfer channel of the first set has its outlet opening in the same axial plane as the outlet opening of any other transfer channel. In contrast, the transfer channels of the second set, when there is one, must be aligned in the same axial plane.

The pivotable button (3) comprises a cylindrical blind hole (31) in the cylindrical wall of which two radial outlet channels (32*a*, 32*b*) are formed one above the other. A groove (33) serves to receive the shoulder (25) of the tip (2). The position of the channels (32*a*, 32*b*) in the cylindrical blind hole is selected so that when the cap (3) is snapped onto the tip (2), the upper outlet channel (32*a*) of the cap is in the same radial plane (at the same height) as the first transfer channel or channels (22*a*, 23*a*) of the tip and the lower outlet channel (32*b*) is located in the same radial plane (at the same height) as the second transfer channel or channels (22*b*, 23*b*) of the tip.

To facilitate handling of the cap, the blind hole (31) is surrounded by an ergonomic ring (34) and an arrow (35) formed on the top of the button facilitates identification of the position of the cap.

In order to ensure sealing between the tip (2) and the pivotable button (3) and thus prevent the product from flowing in the gap between these two parts, seals are provided around each outlet opening of the various transfer channels (22*a*, 22*b*, 23*a*, 23*b*).

In the example presented here, this function is performed by a seal unit (4) essentially constituted by three sealing rings (41*a*, 41*b*, 41*c*) interconnected by straight elements (42*a*, 43*a*). A first window (42) is formed by the space located, on the one hand, between the upper sealing ring (41*a*) and the intermediate sealing ring (41*b*), and on the other hand, between the two upper vertical straight elements (42*a*). Similarly, a second window (43) is formed by the space located, on the one hand, between the intermediate ring (41*b*) and the lower sealing ring (41*c*), and on the other hand, between the two vertical straight elements (43*a*). The two windows are shifted 180° relative to each other as well as well as shifted in height. If the tip comprises a second set of transfer channels (23*a*, 23*b*), a second set of windows arranged one above the other, shifted 90° relative to the windows of the first set (42, 43), must be provided.

This seal unit (4) is arranged in corresponding grooves (24*a/b*) formed on the outer wall of the cylindrical element of the tip (2). This seal unit is preferably injected into the prefabricated tip. The elastomer is injected via an injection chamber (28) located on the top face of the nozzle, passes through an injection channel (29) that opens into the upper groove (24*a*) intended for the upper sealing ring (41*a*), spreads through the vertical grooves (24*b*) intended for the vertical straight elements (42*a*, 43*a*), until the groove intended for the lower sealing ring (41*c*). Thus, in addition to the sealing rings (41*a*, 41*b*, 41*c*) and vertical elements (42*a*, 43*a*), a tab (44*a*) is formed in the injection chamber (28) and a connecting element (45) is formed in the injection channel (29).

In another alternative embodiment shown on FIG. 13, the seal unit is made in the form of a cylindrical sleeve surrounding the outer face of the cylindrical element of the tip. This sleeve has respective holes (42*c*, 43*c*) in the area of the outlet openings of each transfer line of the first set (22*a*, 22*b*), and two other holes (42*d*, 43*d*) in the area of the outlet openings of the second set of transfer channels (23*a*, 23*b*).

It would be also possible to provide separate seals surrounding each outlet opening of the transfer channels (22*a*, 22*b*, 23*a*, 23*b*).

FIGS. 8, 9 and 10 show the diffuser of the invention mounted on a pressurized container.

The tip (2) is fitted on the protruding portion of the stem (82). The upper end of the portion of the central channel (821) that projects above the annular channel (823) is sealingly fitted into the first portion (211) of the blind hole of the tip and the upper end of the portion of the annular channel (823) that projects above the cup is sealingly fitted into the second portion (212). Thus, the outlet of each pathway of the two-way valve is separated from the other inside the tip (2). The two products do not meet within the tip.

The first portion (211) of the blind hole and the first transfer chamber (214) serve as means for sealingly connecting it the first transfer channel (22*a*) to the outlet (821*a*) of the first pathway of the valve. Similarly, the second portion (212) of the blind hole and the intermediate portion (213) forming in the assembled state the second transfer chamber (213') serve as means for sealingly connecting the second transfer channel (22*b*) to the outlet (823*a*) of the second pathway of the valve.

The pivotable cap (3) is snapped onto the tip (2) by penetration of the shoulder (25) of the tip into the groove (33) of the cap. This cap (3) can swivel about the cylindrical portion of the tip (2). The outlet channels (32*a*, 32*b*) of the cap can be aligned, as required,

- with the first transfer channel (22*a*) in contact with the pathway of the valve coming from the first pouch (position "A" shown in FIG. 9);
- with the second transfer channel (22*b*) in contact with the pathway of the valve coming from the inside of the housing or from the second pouch (position "B" shown in FIG. 10);
- with the two transfer channels (23*a*, 23*b*) of the second set of channels, if they exist (position "A+B" shown in FIG. 11); or
- with the non-perforated wall of the tip (position "OFF" shown in FIG. 8).

Thanks to the seals surrounding the outlets of each transfer channel (22*a*, 22*b*, 23*a*, 23*b*), the two products cannot come into contact with one another prior to leaving the pivotable cap.

In the "OFF" position of FIG. 8, if pressure is exerted on the cap (3) and/or on the radial wall (26) of the tip (2), the stem (82) is moved downwards, the orifices (822, 824) of the channels (821, 823) of the stem are freed. The valve is open, but none of the transfer channels (22*a*, 22*b*, 23*a*, 23*b*) is aligned with one of the outlet channels (32*a*, 32*b*) of the cap. Consequently, no product is expelled from the container.

In the "A" position shown in FIG. 9, the outlet channel (32*a*) is aligned with the first transfer channel (22*a*), the other channels (22*b*, 23*a*, 23*b*) being blocked by the solid wall of the blind hole (31) of the cap. If pressure is exerted on the cap (3) or on the radial wall (26) of the tip, the stem (82) is moved downwards, freeing the orifices (822, 824) of the two channels (821, 823) of the stem. However, only the central channel (821) is in contact with the outside via the first transfer channel (22*a*) and the first outlet channel (32*a*). Consequently, only the product contained in the inner pouch can leave.

In the "B" position shown in FIG. 10, the outlet channel (32*b*) is aligned with the second transfer channel (22*b*), the other channels (22*a*, 23*a*, 23*b*) being blocked by the wall of the blind hole (31) of the cap. If pressure is exerted on the cap (3) or on the radial wall (26) of the tip, the stem is moved downwards, freeing the orifices (822, 824) of the two channels (821, 823) of the stem. However, only the annular channel (823) is in contact with the outside via the second transfer channel (22*b*) and the second outlet channel (32*b*). Consequently, only the product contained in the housing or in the outer pouch can leave.

If a second set of transfer channels (23*a*, 23*b*) is provided in the tip (see FIG. 11), it is then possible to put the cap in the "A/B" position opposed to the "OFF" position. In this case, the two outlet channels (32*a*, 32*b*) of the cap are aligned with the two transfer channels (23*a*, 23*b*) of the second set of channels. In contrast, the channels (22*a*, 22*b*) of the first set are blocked by the wall of the blind hole (31) of the cap. If pressure is exerted on the cap (3) or on the radial wall (26) of the tip, the stem is moved downwards, freeing the orifices (822, 824) of the two channels (821, 823) of the stem. This time, both the central channel (821) and the annular channel (823) of the stem are in contact with the outside via the two transfer channels (23*a*, 23*b*) and the two outlet channels (32*a*, 32*b*). Consequently, the two products can be withdrawn simultaneously.

The principle described here for two pathways can be generalized to a valve having more than two outlet pathways. The transfer channels of the first set are no longer disposed at 180° relative to each other, but they are more or less evenly distributed as needed over the entire circumference of the tip. The cap is provided with as many outlet channels arranged one above the other as there are pathways in the valve.

It is not necessary that the outlet channels of the stem be concentric and open upwardly. With few changes, which are within the skill of the person of the art, it would be possible, for example, to adapt the tip of the invention to a two-way valve with parallel outlets, such as described for example in DE 76 31 034 U 1.

Thanks to the diffuser of the invention, it is possible to withdraw only one of the products from a container fitted with a multiway valve. If necessary, however, it is possible to provide means for withdrawing all the products simultaneously, as in a conventional diffuser. At no time do products come into contact with one another before leaving the diffuser. By selecting as many outlet channels (32*a*, 32*b*) as there are products to be withdrawn, the separation of the pathways is guaranteed until leaving the diffuser.

The diffuser of the invention can be used in many areas, and in particular for

- technical products, such as glues, resins, lubricants, cleaners, paints, paint strippers, polyurethane foam or other, etc. . . . ,
- cosmetic products, such as lotions, creams, soaps, shampoos, make up or shaving products, depilatory products, hair care products (hair dyes or bleaches, hair curling or straightening products, anti-lice products, . . . ), etc. . . . ,
- food products such as sweet or savory sauces, spreads, cheeses, pâtés, mousses, oils, vinegars, butters, margarines, etc. . . . ,
- pharmaceuticals, such as ophthalmic products, sprays for nasal, aural or oral use, healing products, disinfectants, analgesics, anti-inflammatories, antibiotics, coagulants, anti-septic, etc. . . . ,
- cleaning products such as furniture waxes, shoe polishes, window washing products, etc. . . . ,
- various products such as pastes for casts (dental, aural, . . . ), insecticides, air fresheners, etc. . . .

LIST OF REFERENCES

1 Diffuser of the invention
2 Tip
21 Blind hole of the tip
211 First portion of the blind hole
212 Second portion of the blind hole
213 Intermediate portion (213': second transfer chamber)
214 First transfer chamber
215 First flaring part
216 Second flaring part
22*a/b* First/second transfer channel (first set of channels)
23*a/b* First/second transfer channel (second set of channels)
24 Groove for the seal
24*a* Annular portions
24*b* Vertical portions
25 Snapping shoulder
26 Radial wall
27 Axial ring
28 Injection chamber
29 Injection channel
3 Cap
31 Blind hole of the cap
32*a/b* First/second outlet channel
33 Snapping groove
34 Ring
35 Arrow
4 Seal unit
41*a/b/c* Upper/middle/lower sealing ring
42 First window
42*a* Vertical elements around the first transfer channel
43 Second window
43*a* Vertical elements around the second transfer channel
44 Injection tab
45 Connecting element
8 Two-way valve
81 Valve body
811 Central channel
812 Lateral fins
813 Side channel
813*a* Lower openings of the side channels
814 Orifices at the top of the side channels
82 Stem
821 Central channel
821*a* Upper opening of the central channel
822 Orifices at the bottom of the central channel
823 Annular channel
823*a* Upper opening of the central channel
824 Orifices at the bottom of the annular channel
83 Cup
84 Ring
85 First inner seal
86 Second inner seal
87 Spring
9 Housing

The invention claimed is:

1. Diffuser for a multiway valve having a plurality of pathways provided with a projecting stem, wherein the diffuser comprises:

a tip intended to be secured to a projecting portion of the stem, wherein the tip comprises a cylindrical portion having a circular cross-section, wherein the tip comprises a first set of transfer channels, comprising first transfer channels wherein a total number of the first transfer channels is equal to a total number of the pathways in the multiway valve, wherein each of said first transfer channels corresponds to a respective pathway among the pathways in the multiway valve, each respective first transfer channel among said first transfer channels being provided with connecting means for sealingly connecting said respective first transfer channel to an outlet of the corresponding pathway among the pathways of the multiway valve when the tip is mounted on the multiway valve, wherein each of said first transfer channels opens on an outer face of the cylindrical portion of the tip in a different radial plane and in a different angular sector of the cylindrical portion of the tip, and a pivotable cap having a central portion provided with a blind hole having a shape complementary to the cylindrical portion of the tip, wherein the pivotable cap is rotatably secured to the cylindrical portion of the tip, wherein the pivotable cap comprises a set of outlet channels comprising outlet channels, wherein a total number of the outlet channels is equal to the total number of the first transfer channels in the tip, wherein each of said outlet channels corresponds to a respective first transfer channel in the first set of transfer channels of the tip, wherein said outlet channels are arranged in a row in a same first axial plane and are arranged in same radial planes as the corresponding first transfer channels of the tip, so that by pivoting the pivotable cap, each of said outlet channels can be aligned with the corresponding one of the first transfer channels without simultaneously aligning the other outlet channels with the corresponding other first transfer channels, wherein first seals are provided around each outlet opening of the first transfer channels to ensure sealing between the outer face of the cylindrical portion of the tip and an inside of the blind hole of the pivotable cap, wherein all the first seals are combined into a same seal unit having first windows, wherein a total number of the first windows is equal to the total number of the first transfer channels, said first windows being arranged so that each of said first windows surrounds the outlet opening of a respective one of said first transfer channels.

2. Diffuser according to claim 1, wherein the tip comprises a second set of transfer channels comprising second transfer channels, wherein a total number of the second transfer channels is equal to the total number of the pathways in the multiway valve, the second transfer channels being arranged in a row in a same second axial plane, in an angular sector different from the transfer channels of the first set of transfer channels, wherein each respective first transfer channel of the first set communicates with a respective second transfer channel of the second set of transfer channels arranged in a same radial plane.

3. Diffuser according to claim 2, wherein the total number of the first transfer channels is two and the two first transfer channels are formed in the cylindrical portion of the tip, each of the first transfer channels opening outside the cylindrical portion of the tip in the respective different radial plane and in a same third axial plane but at 180° relative to one another, and wherein the total number of the outlet channels is two and the two outlet channels are arranged in a row in the same first axial plane and are arranged in the same radial planes as the corresponding first transfer channels, and wherein the second set of transfer channels comprises two second transfer channels, said second transfer channels being placed in the same second axial plane perpendicular to the third axial plane containing the first transfer channels of the first set.

4. Diffuser according to claim 2, wherein second seals are provided around each outlet opening of the second transfer channels to ensure sealing between the outer face of the cylindrical portion of the tip and the inside of the blind hole of the pivotable cap.

5. Diffuser according to claim 4, wherein the first seals and the second seals are combined into a same seal unit having (i) the first windows and (ii) second windows, wherein a total number of the second windows is equal to a total number of the second transfer channels, said second windows being arranged so that each of said second windows surrounds the outlet opening of a respective one of said second transfer channels.

6. Diffuser according to claim 5, wherein the seal unit is formed by a total number of sealing rings equal to the total number of the pathways in the multiway valve minus one, the sealing rings being arranged in a row, and two successive of said sealing rings being joined together by two straight elements so as to form a respective one of said first windows.

7. Diffuser according to claim 5, wherein the seal unit is formed by a sleeve in which a total number of openings are formed equal to a sum of the total number of the first transfer channels and a total number of the second transfer channels, each of said openings forming a respective one of said first windows and said second windows.

8. Diffuser according to claim 2, wherein the pivotable cap is provided with a prehension ring surrounding the central portion of the pivotable cap provided with the blind hole.

9. Diffuser according to claim 2, wherein the connecting means of each said respective first transfer channel is formed by a hole having dimensions complementary to dimensions of the outlet of the corresponding pathway of the multiway valve, so as to be able to be sealingly fitted onto said outlet, and by a transfer chamber from which the respective first transfer channel starts, the transfer chamber being arranged so that the corresponding pathway of the multiway valve opens into the transfer chamber when the diffuser is in position mounted on the multiway valve.

10. Diffuser according to claim 2, which is mounted on the multiway valve.

11. Diffuser according to claim 10, wherein the multiway valve is provided with a total number of the pouches is equal to the total number of the pathways.

12. Diffuser according to claim 1, wherein the seal unit is formed by sealing rings, wherein a total number of the sealing rings plus one is equal to the total number of the first transfer channels, the sealing rings being arranged in a row, and two successive of said sealing rings being joined together by two straight elements so as to form a respective one of said first windows.

13. Diffuser according to claim 1, wherein the seal unit is formed by a sleeve in which openings are formed, wherein a total number of the openings is equal to the total number of the first transfer channels, each of said openings forming a respective one of said first windows.

14. Diffuser according to claim 1, wherein the pivotable cap is provided with a prehension ring surrounding the central portion of the pivotable cap provided with the blind hole.

15. Diffuser according to claim 1, wherein the connecting means of each said respective first transfer channel is formed by a hole having dimensions complementary to dimensions of the outlet of the corresponding pathway of the multiway valve, so as to be able to be sealingly fitted onto said outlet, and by a transfer chamber from which the respective first transfer channel starts, the transfer chamber being arranged so that the corresponding pathway of the multiway valve opens into the transfer chamber when the diffuser is in position mounted on the multiway valve.

16. Diffuser according to claim 1, wherein the total number of the first transfer channels is two and the two first transfer channels are formed in the cylindrical portion of the tip, each of the first transfer channels opening outside the cylindrical portion of the tip in the respective different radial plane and in a same third axial plane but at 180° relative to one another, and wherein the total number of the outlet channels is two and the two outlet channels are arranged in a row in the same first axial plane and are arranged in the same radial planes as the corresponding first transfer channels.

17. Diffuser according to claim 1, which is mounted on the multiway valve.

18. Diffuser according to claim 17, wherein the multiway valve is provided with pouches, wherein a total number of the pouches is equal to the total number of the pathways.

19. Diffuser according to claim 18, wherein the pathways of the multiway valve have concentric outlets.

20. Diffuser according to claim 17, wherein the multiway valve is a two-way valve.

* * * * *